US008430383B2

(12) United States Patent
Strauss

(10) Patent No.: US 8,430,383 B2
(45) Date of Patent: Apr. 30, 2013

(54) CLAMP WITH A SUPPORT

(75) Inventor: Ralf Strauss, Huntersville, NC (US)

(73) Assignee: Irwin Industrial Tools Company, Huntersville, NC (US)

( * ) Notice: Subject to any disclaimer, the term of this patent is extended or adjusted under 35 U.S.C. 154(b) by 432 days.

(21) Appl. No.: 12/394,649

(22) Filed: Feb. 27, 2009

(65) Prior Publication Data

US 2010/0013133 A1 Jan. 21, 2010

Related U.S. Application Data

(63) Continuation-in-part of application No. 12/175,929, filed on Jul. 18, 2008, now Pat. No. 7,984,895.

(51) Int. Cl.

| | |
|---|---|
| ***B25B 1/00*** | (2006.01) |
| ***B25B 1/20*** | (2006.01) |
| ***B25B 1/24*** | (2006.01) |
| ***B25B 5/16*** | (2006.01) |

(52) U.S. Cl.
USPC ..... 269/5; 269/3; 269/6; 269/43; 269/277

(58) Field of Classification Search ..... 269/5, 3, 269/6, 41, 43, 156, 277
See application file for complete search history.

(56) References Cited

U.S. PATENT DOCUMENTS

| | | | | |
|---|---|---|---|---|
| 4,662,618 | A * | 5/1987 | Willis | 269/43 |
| 5,265,854 | A * | 11/1993 | Whiteford | 269/3 |
| 5,526,715 | A * | 6/1996 | Swann et al. | 74/822 |
| 5,799,933 | A | 9/1998 | Yang | |
| 5,853,168 | A * | 12/1998 | Drake | 269/6 |
| 6,029,964 | A | 2/2000 | Bohl | |
| 6,240,815 | B1 | 6/2001 | Huang | |
| 6,438,854 | B1 * | 8/2002 | Kott, Jr. | 33/286 |
| 6,568,667 | B1 * | 5/2003 | Hall | 269/6 |
| 6,752,059 | B1 * | 6/2004 | Posont | 83/745 |
| 6,802,988 | B1 * | 10/2004 | Wenderoth et al. | 252/73 |
| 7,086,312 | B1 * | 8/2006 | Tortolani | 81/355 |

(Continued)

FOREIGN PATENT DOCUMENTS

| | | |
|---|---|---|
| GB | 122063 | 1/1919 |
| JP | 58-31959 U | 8/1981 |

(Continued)

OTHER PUBLICATIONS

European Search Report dated Aug. 12, 2009.

(Continued)

*Primary Examiner* — Lee D Wilson
*Assistant Examiner* — Alvin Grant
(74) *Attorney, Agent, or Firm* — Dennis J. Williamson; Moore & Van Allen PLLC

(57) ABSTRACT

A clamp comprising a bar supporting a movable jaw having a first support surface. The bar is slidably received in a jaw body and the jaw body supports a fixed jaw. A support is slidably disposed on the bar and has a second support surface that is coplanar with the first support surface such that the clamp can be supported on the first support surface and the second support surface on a surface. In one method of operating the clamp a work piece is positioned directly on the bar. In another method of operating the clamp the movable jaw is moved relative to the fixed jaw and is stopped by the engagement of the support with the body.

17 Claims, 13 Drawing Sheets

U.S. PATENT DOCUMENTS

| | | | | |
|---|---|---|---|---|
| 7,172,183 | B1 * | 2/2007 | Yang | 269/6 |
| 7,546,996 | B2 * | 6/2009 | Somji | 248/451 |
| 7,604,224 | B2 * | 10/2009 | Rowlay et al. | 269/6 |
| 7,631,434 | B1 * | 12/2009 | Carter, Jr. | 33/293 |
| 7,651,078 | B2 * | 1/2010 | Geier et al. | 269/6 |
| 7,735,813 | B2 * | 6/2010 | Geier et al. | 269/6 |
| 7,849,630 | B2 * | 12/2010 | Carnevali | 43/21.2 |
| 2007/0138367 | A1 * | 6/2007 | Somji | 248/447.2 |
| 2008/0179801 | A1 * | 7/2008 | Geier et al. | 269/6 |

FOREIGN PATENT DOCUMENTS

| | | |
|---|---|---|
| JP | 07-186056 | 7/1995 |
| TW | 051141 | 6/1983 |
| TW | 088663 | 7/1987 |
| TW | 397741 B | 7/2000 |

OTHER PUBLICATIONS

Japanese Patent Office, Office Action, Japanese Patent Application No. 2009-169821, Jan. 12, 2012.

Japanese Patent Office, Office Action, Japanese Patent Application No. 2009102584302, Oct. 26, 2011.

Irwin Industrial Tool Company, Taiwanese Patent Application No. 098124295, Search Report, Oct. 5, 2012.

* cited by examiner

CLAMP WITH A SUPPORT

This application is a continuation-in-part of, and claims the benefit of, the filing date under 35 U.S.C. §120 of U.S. patent application Ser. No. 12/175,929, filed Jul. 18, 2008, the disclosure of the above application is incorporated herein by reference in its entirety.

BACKGROUND

Many different types of clamps are known such as bar clamps, C-clamps, spring clamps, vises, pipe clamps and the like. A typical clamp comprises a pair of jaws that are movable toward and away from one another such that a workpiece may be gripped between the jaws and pressure applied thereto. The relative movement of the jaws toward and away from one another may be accomplished by a variety of different mechanisms. For example, it is known to use screws, cams, sliding mechanisms, springs and the like to move one or both of the jaws toward and away from one another. One type of clamp is known as a one-handed bar clamp that uses a "trigger" type grip to effectuate movement of the jaws.

An improved support structure for a clamp and an improved clamp are desired.

SUMMARY OF THE INVENTION

A clamp comprising a bar supporting a movable jaw having a first support surface is provided. The bar is slidably received in a body supporting a fixed jaw. A support is slidably disposed on the bar and has a second support surface that is coplanar with the first support surface such that the clamp can be supported by the first support surface and the second support surface on a surface.

A method of operating a clamp having a bar supporting a movable jaw having a first support surface where the bar is slidably received in a body having a fixed jaw. A support is slidably disposed on the bar and has a second support surface that is coplanar with the first support surface such that the clamp can be supported by the first support surface and the second support surface on a surface. The support is positioned on the bar such that the clamp is supported in a free-standing manner on the surface. A work piece is positioned directly on the bar. The movable jaw is moved relative to the fixed jaw to clamp the work piece between the jaws.

A method of operating a clamp having a bar supporting a movable jaw where the bar is slidably received in a body having a fixed jaw. A support is slidably disposed on the bar. The support is positioned on the bar. The movable jaw is moved relative to the fixed jaw and is stopped by the engagement of the support with the body.

DETAILED DESCRIPTION OF EMBODIMENTS OF THE INVENTION

Figure 1:
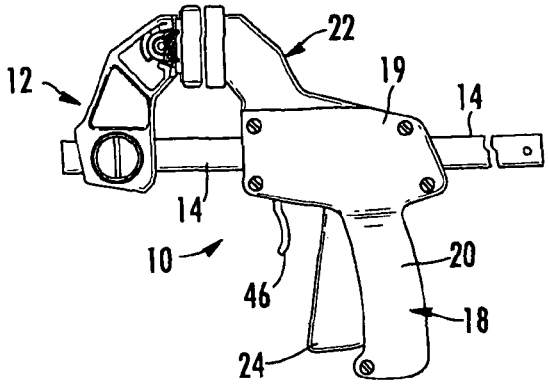
FIG. 1 is a side view of an embodiment of a clamp using the jaw assembly of the invention.
Figure 2:
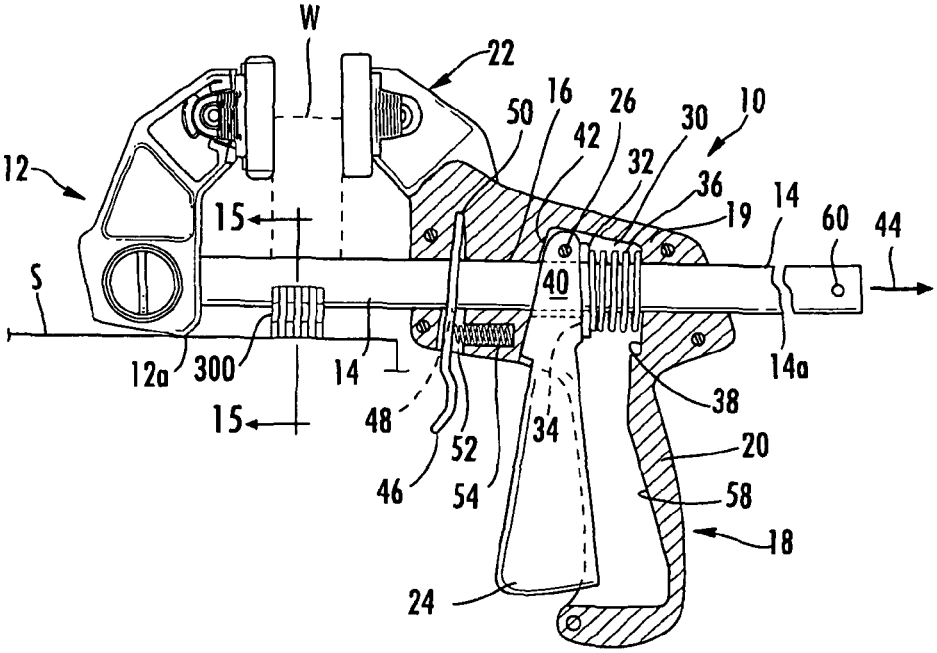
FIG. 2 is a partially cut-away side view showing the interior structure of the clamp of claim 1.

Referring to FIGS. 1 and 2 an embodiment of a bar clamp useful for showing the structure and operation of the jaw of the invention. Bar clamp 10 includes a movable jaw assembly 12 connected to a slide bar 14. The slide bar is slidably supported in a slot 16 which passes through a handle/grip assembly 18.

The handle/grip assembly 18 includes a body 19 through which the slot 16 passes, a handgrip 20 attached to the body 19 on one side of the slot 16, and a fixed jaw assembly 22 attached to the body 19 on the other side of the slot 16. A trigger handle 24 is pivotably mounted to the body 19 adjacent the slot 16 such as by a pivot pin 26. The movable jaw assembly 12 includes a jaw face that opposes a jaw face on the fixed jaw assembly 22 such that the jaw faces contact the workpiece.

A driving lever 32 is suspended on the slide bar 14 which passes through a hole 34 in the driving lever 32. A spring 36 is compressed between the driving lever 32 and a surface 38 of the body 19 urging the driving lever 32 against the upper end 40 of the trigger handle 24. The upper end 40 of the trigger handle 24 is forked and straddles the slide bar 14. The force generated by the spring 36 urges the trigger handle 24 against an inner surface 42 of the body 19 thus providing a standby condition. In the standby condition, the driving lever 32 is positioned substantially perpendicular to the direction of motion of the slide bar 14 when in operation. Any motion of the handle 24 about the pivot pin 26 in the direction of the arrow 44 is accomplished against the bias of the spring 36.

A braking lever 46 is suspended from the slide bar 14 which passes through an opening 48 in the braking lever 46. One end 50 of the braking lever 46 is pivotably captured in a recess 52 within the body 19 such that the braking lever 46 may pivot within constraints defined by the surfaces of the recess 52 and by binding of the braking lever 46 with the slide bar 14 when the edges of the opening 48 in the lever 46 engage the surface of the slide bar 14. A spring 54 biases the free end of the braking lever 46 away from the trigger handle 24. The biased position of the braking lever 46 is limited by the binding interference between the opening 48 of the lever 46 with the slide bar 14.

In the standby position illustrated in FIG. 2, the driving lever 32 is substantially perpendicular to the longitudinal axis of the slide bar 14, whereas the portion of the braking lever 46 which engages the slide bar 14 is transverse to the longitudinal axis of the bar 14 but not perpendicular thereto. In this condition, if a force is applied to the movable jaw assembly 12 in the direction indicated by the arrow 44, the slide bar 14 is free to move through the hole 34 in the driving lever 32. Because the braking lever 46 is free to pivot against the bias of the spring 54 when force is applied on the movable jaw assembly 12 in the direction of the arrow 44, the braking lever 46 presents no obstacle to this motion of the slide bar and the movable jaw assembly 12 may be advanced continuously toward the fixed jaw assembly 22.

However, if a force is applied to the movable jaw assembly 12 in the direction opposite to the direction indicated by the arrow 44, the edges of the opening 48 in the braking lever 46 bind against the surface of the slide bar 14 and it is not possible, without further action, to move the movable jaw assembly 12 farther away from the fixed jaw assembly 22. Compression of the spring 54 by pressing on the braking lever 46 in the direction of the arrow 44, allows withdrawal of the slide bar 14 and movable jaw assembly 12 away from the fixed jaw assembly 22. This force brings the end 50 of the lever 46 into perpendicularity with the direction of intended motion of the slide bar 14. The slide bar 14 is free to slide in either direction through the opening 48 in the braking lever 46.

The trigger handle 24 is squeezed in the direction indicated by the arrow 44 to incrementally advance the slide bar 14 with its attached movable jaw assembly 12 toward the fixed jaw assembly 22. When the handle 24 is squeezed between a user's hand (not shown) and the handgrip 20, pivoting occurs about the pivot pin 26 and the end 40 of the trigger handle 24 moves in the direction of the arrow 44. This causes the driving lever 32 to pivot about its upper end, so that the driving lever 32 is no longer perpendicular to the direction 44 of intended motion of the slide bar 14. Pivoting the driving lever 32 compresses the spring 36 and also causes the edges of the hole 34 through the driving lever 32 to bind against the surface of the slide bar 14. Binding occurs because the driving lever 32 is no longer perpendicular to the direction 44 of intended motion of the slide bar 14. Further motion of the trigger handle 24 causes the driving lever 32 to translate in the direction of the arrow 44. This motion further compresses the spring 36 and, due to the binding interference between the lever 32 and bar 14, advances the bar 14 and its connected movable jaw assembly 12 toward the fixed jaw assembly 22. Release of the trigger handle 24 causes the return of the trigger handle 24, driving lever 32 and spring 36 to the position shown in FIG. 2 due to the compressive forces in the spring 36 urging the components toward the movable jaw assembly 12. Additional strokes may be applied to the trigger handle 42 of any magnitude until the jaw assemblies 12, 22 come together, or a workpiece W is firmly gripped between them. While one such drive mechanism for a bar clamp is illustrated it is to be appreciated that the drive mechanism for a bar clamp may vary from that shown in FIGS. 1 and 2 and that numerous different types of drive mechanisms for a bar clamp are known.

In certain clamps, such as those described above, the amount of clamping force generated between the jaws when clamping a workpiece may cause the jaws and/or bar to flex such that the clamping faces of the jaws are no longer parallel to one another. To solve this problem the jaw faces may be angled toward one another such that upon application of a clamping force the distal ends of the jaws flex slightly such that the jaw faces are moved into parallel contact with the workpiece. One problem with such an arrangement is that because the jaw faces initially contact the workpiece at an angle with the outer edge of the jaw face initially contacting the workpiece, the jaw face may make a mark or indentation the workpiece as the clamping force is increased prior to the jaw faces reaching a parallel orientation. Using a swivel jaw allows the jaw faces to orient themselves parallel to the workpiece as soon as contact is made with the workpiece thereby allowing the jaw faces to maintain parallel full contact with the workpiece even while the jaw and/or bar flexes under changing and increasing loads. However, the use of a swivel jaw creates another problem where the distal edges of the jaw faces cannot be used to grip the edge of a workpiece because the jaws simply rotate backward out of engagement with the workpiece and the clamp slips off of the workpiece. "Distal" as used herein refers to the edge of the jaw toward the outside of the clamp (the top of jaw 104 as viewed in FIG. 3) and "proximal" as used herein refers to the inner edge of the jaw closest to bar 14 (the bottom of jaw 104 as viewed in FIG. 3)

The locking rotating jaw assembly of the invention allows the jaw to rotate to align itself parallel to the workpiece regardless of the loading while the ability to lock the swiveling jaw allows the clamp to grip a workpiece using only the distal edges of the jaws without the jaws swiveling backward out of contact with the workpiece. While the jaw assembly is shown on a bar clamp as described above, it is to be understood that the locking rotating jaw may be used on any clamp where jaws move toward and away from one another to clamp a workpiece therebetween and apply pressure to the workpiece. Further, one of the jaws may be provided with the locking pivoting jaw assembly as shown in FIG. 1 or both jaws may be provided with the locking pivoting jaw assemblies as shown in FIG. 2.

Figure 3:
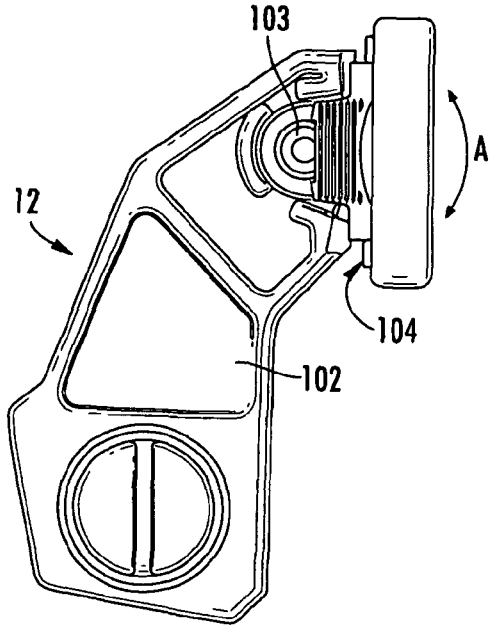
FIG. 3 is a side view of the jaw assembly of the invention.
Figure 4:
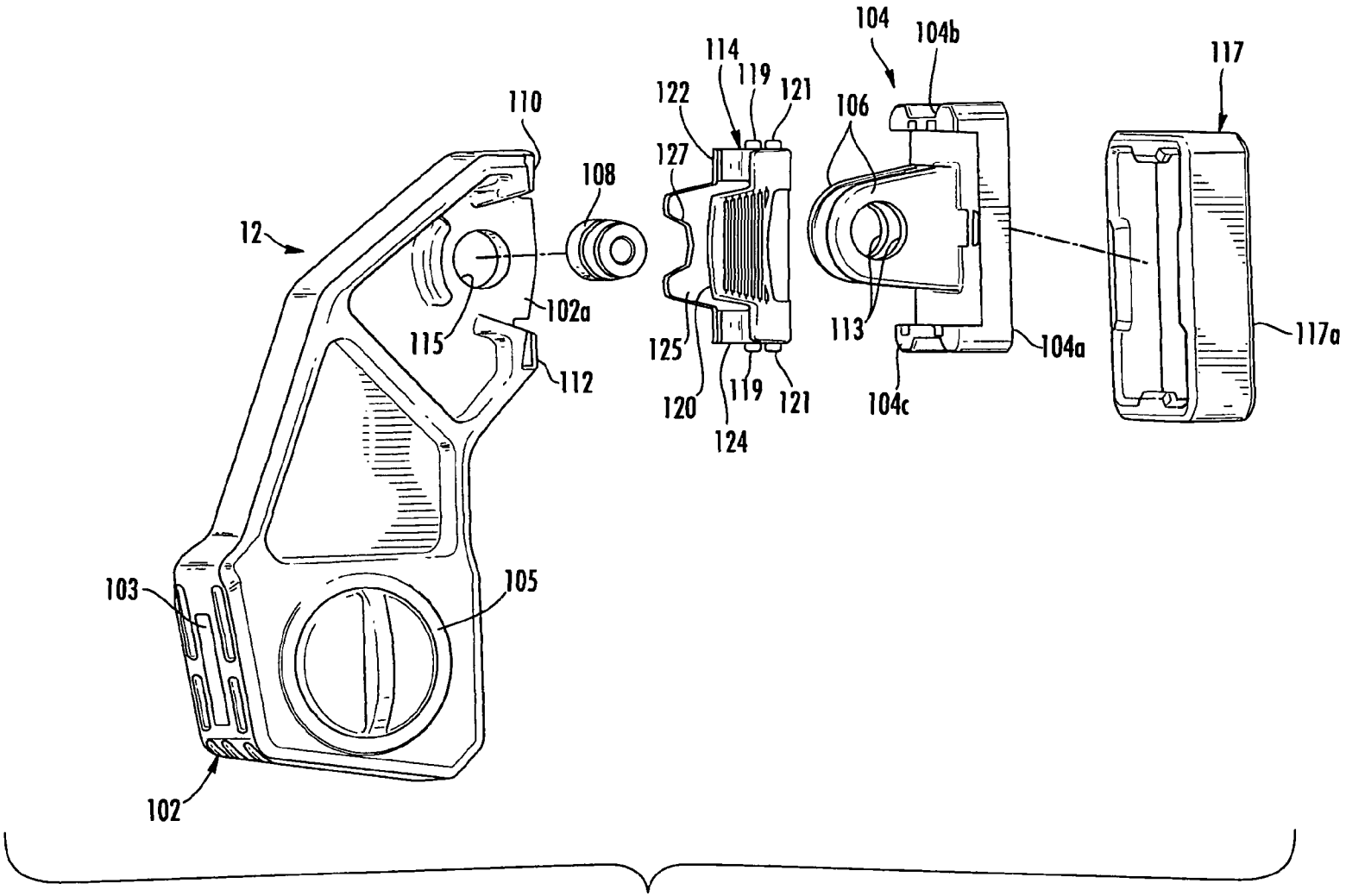
FIG. 4 is an exploded perspective view of the jaw assembly of FIG. 3.
Figure 5:
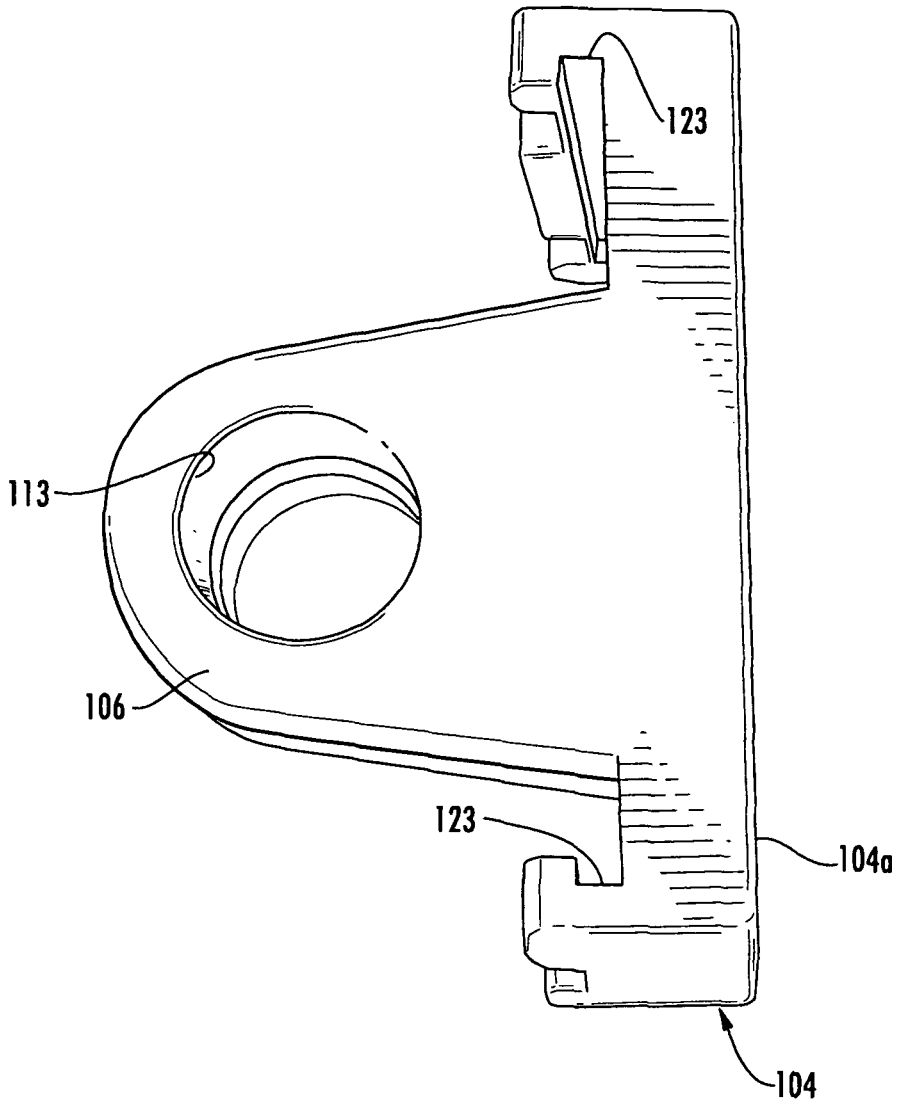
FIG. 5 is a perspective side view of the jaw element used in the jaw assembly of FIG. 3.

Referring to FIGS. 2 through 4, jaw assembly 12 comprises a jaw body 102 that is connected to the bar 14 such as by a releasable fastener. The jaw body 102 may be removably mounted on the bar such that it can be removed from and repositioned on the bar. A jaw 104 is rotatably connected to the jaw body 102 such that it can rotate in the direction of arrow A (FIG. 3) relative to the jaw body 102. Referring to FIGS. 4 and 5 in one embodiment the jaw 104 includes a pair of flanges 106 that receive a body portion 102*a* of the jaw body 102. Each flange 106 includes a hole 113 that is aligned with hole 115 formed on jaw body portion 102*a*. A pin 108 extends into holes 113 and 115 to retain jaw 104 on jaw body 102 such that the jaw 104 can rotate about the pin 108 in the direction of arrow A. Jaw 104 defines a jaw face 104*a* for contacting the workpiece during the clamping operation. A relatively soft pad 117 may be disposed on jaw 104 to protect the surface of a work piece being clamped between the jaws. Pad 117 includes a face 117*a* that extends over jaw face 104*a* and contacts the workpiece during the clamping operation. The pad 117 may be eliminated if desired. As used herein jaw face is intended to mean the face of the jaw assembly that contacts the workpiece during the clamping operation and includes the face of the jaw, such as face 104*a*, and the face of the pad, such as face 117*a*, when a pad is used.

Figure 8:
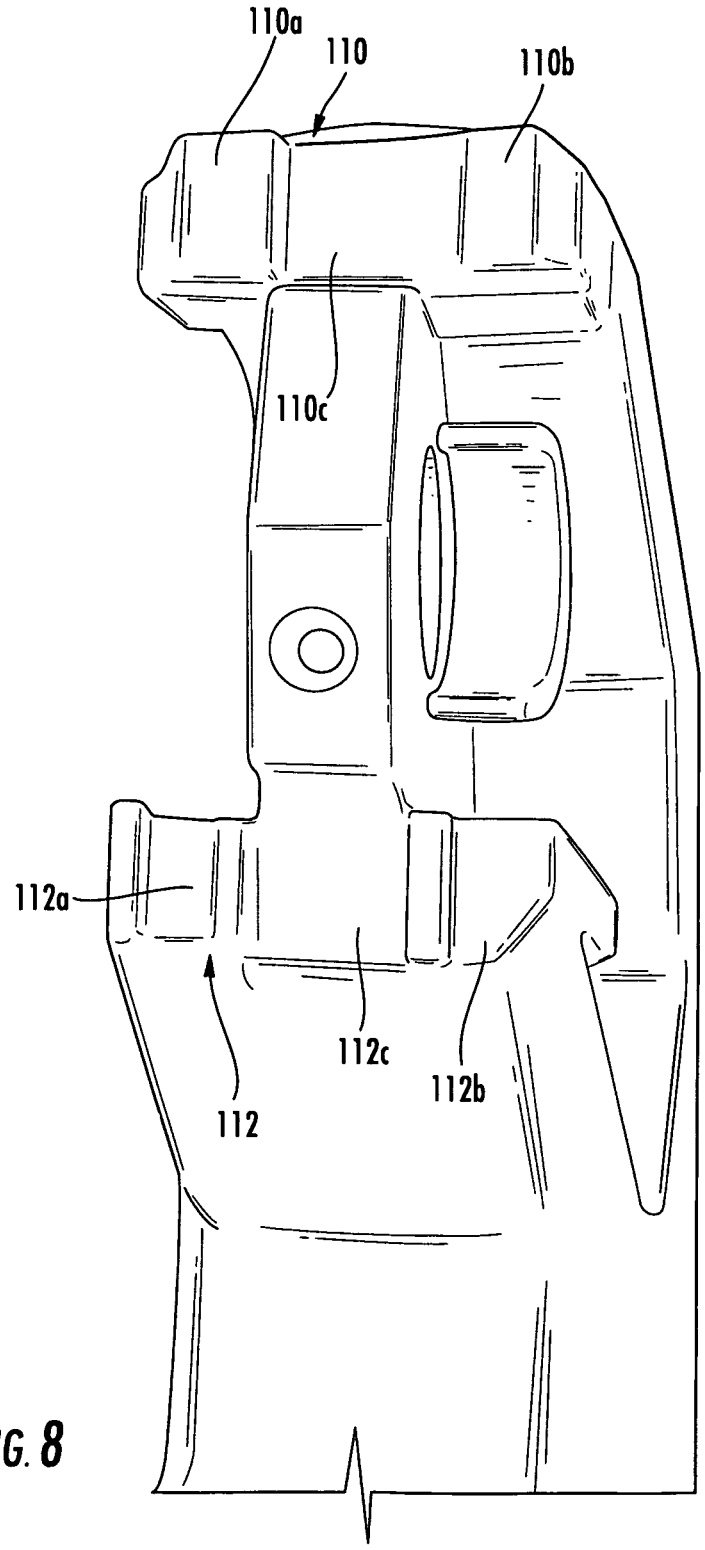
FIG. 8 is a perspective front view of the jaw body.

The jaw body 102 is formed with a pair of walls 110 and 112 that face the back of jaw 104. Wall 110 is disposed above hole 115 and wall 112 is disposed below hole 115 such that wall 110 is opposed to the top end of jaw 104 and wall 112 is opposed to the bottom end of jaw 104. Referring to FIG. 8, wall 110 has two protrusions 110*a* and 110*b* with a recessed portion 110*c* formed between the protrusions. Likewise, wall 112 has two protrusions 112*a* and 112*b* with recessed portion 112*c* formed between the two protrusions.

Figure 6:
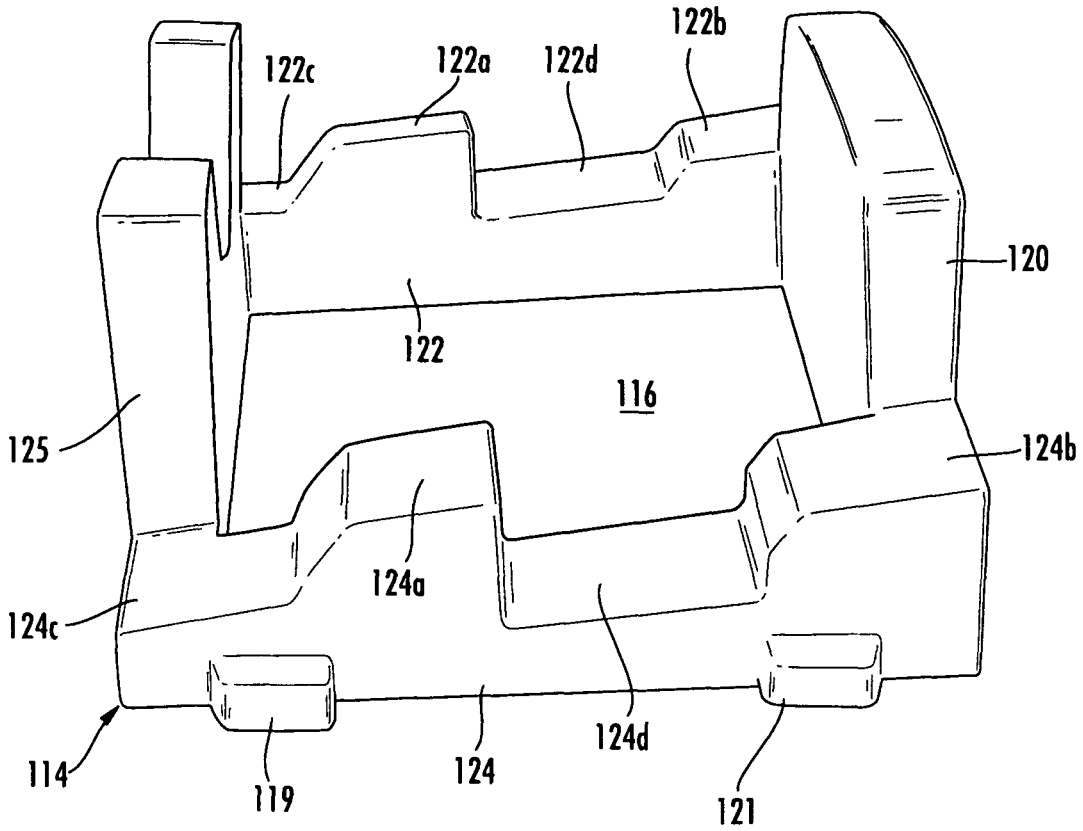
FIG. 6 is a perspective view of the locking member used in the jaw assembly of FIG. 3.
Figure 7:
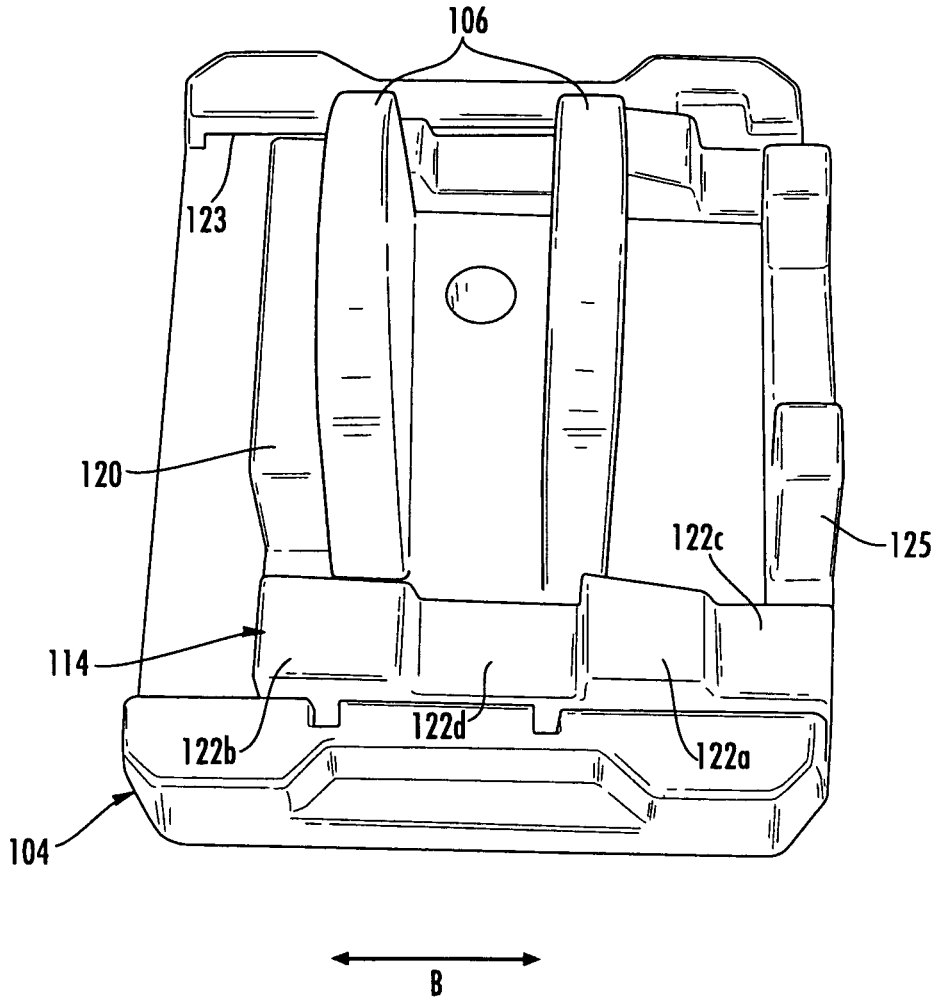
FIG. 7 is a perspective view of the jaw element and locking member.

Referring to FIGS. 4, 6 and 7, a sliding locking member 114 is disposed between the jaw body 102 and the jaw 104. The locking member 114 is secured to the jaw 104 such that locking member 114 pivots with the jaw 104 about pivot pin 108. Locking member 114 defines an interior opening 116 through which the flanges 106 extend. The opening 116 is larger than the combined width of the flanges 106 such that the locking member 114 can slide relative to the jaw 104 in a direction parallel to the axis of pivot pin 108. Locking member 114 includes a pair of flanges 119 and 121 on the upper and lower edges thereof. Flanges 119 and 121 fit into mating slots 123 (FIG. 5) formed along the inner upper and lower edges of jaw 104 such that the locking member 114 can slide relative to the jaw 104 in a direction parallel to the axis about which jaw 104 pivots (the longitudinal axis of pivot pin 108).

The locking member 114 further includes a flange 125 having a recess 127 for receiving the pin 108. A push tab 120 is formed on the opposite side of locking member 114 and is manually manipulated by a user to slide the locking member 114 relative to jaw 104 (arrow B, FIG. 7) to lock and unlock the jaw 104 as will hereinafter be described.

The locking member 114 also includes an upper wall 122 and a lower wall 124 where wall 122 is disposed opposite wall 110 and wall 124 is disposed opposite wall 112. Wall 122 has two protrusions 122*a* and 122*b* interleaved with two recessed portions 122*c* and 122*d*. Wall 124 has two protrusions 124*a* and 124*b* interleaved with two recessed portions 124*c* and 124*d*.

Figure 9:
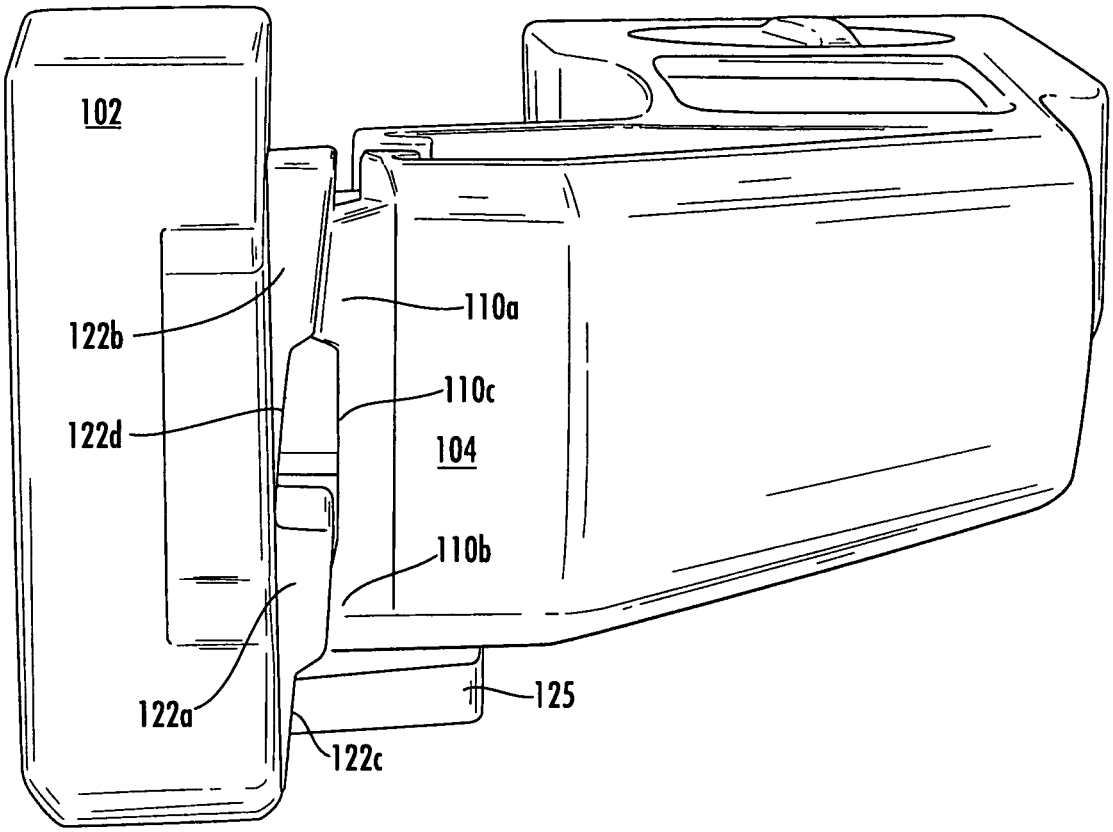
FIG. 9 is a perspective top view showing the jaw in the locked position.

The walls 122 and 124 of the locking member 114 are disposed such that when the locking member is in a first locked position the protrusions 122*a* and 122*b* of the locking member 114 are aligned with the protrusions 110*a* and 110*b* on wall 110 of the jaw body 102 and the protrusions 124*a* and 124*b* are aligned with the protrusions 112*a* and 11 2*b* on wall 112 of the jaw body 102. The engagement of the protrusions 110*a*, 110*b* with protrusions 122*a*, 122*b* is shown in FIG. 9, it being understood that the engagement of protrusions 112*a*, 112*b* with protrusions 124*a*, 124*b* is the same. In this position the protrusions on the locking member 114 and jaw body 102 contact each other to prevent the face 104 from rotating about pin 108 in either direction. The protrusions are dimensioned such that in the locked position, the face 104*a* of the jaw 104 is disposed substantially perpendicular to the direction of relative movement of the jaws. The protrusions may be formed with surfaces angled with respect to the direction of movement of the locking member 114 to facilitate the movement of the protrusions over one another as the locking member 114 is moved between the locked and unlocked positions. The surfaces may be arranged parallel to the direction of movement of locking member 114.

Figure 10:
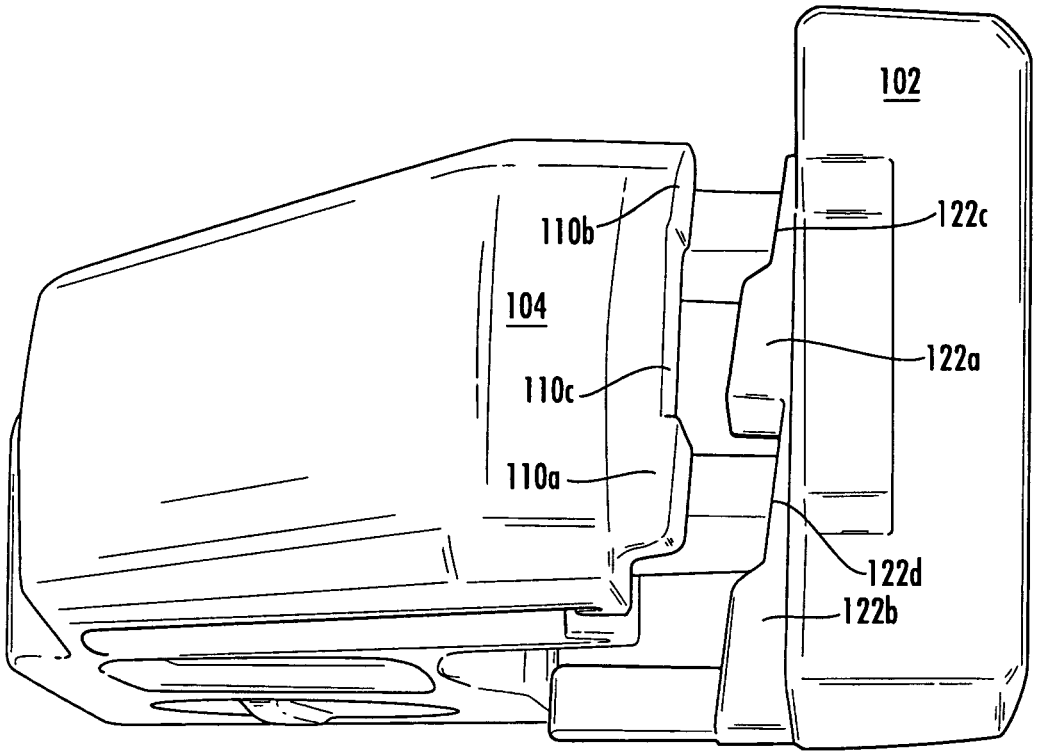
FIG. 10 is a perspective top view showing the jaw in a first unlocked position.
Figure 11:
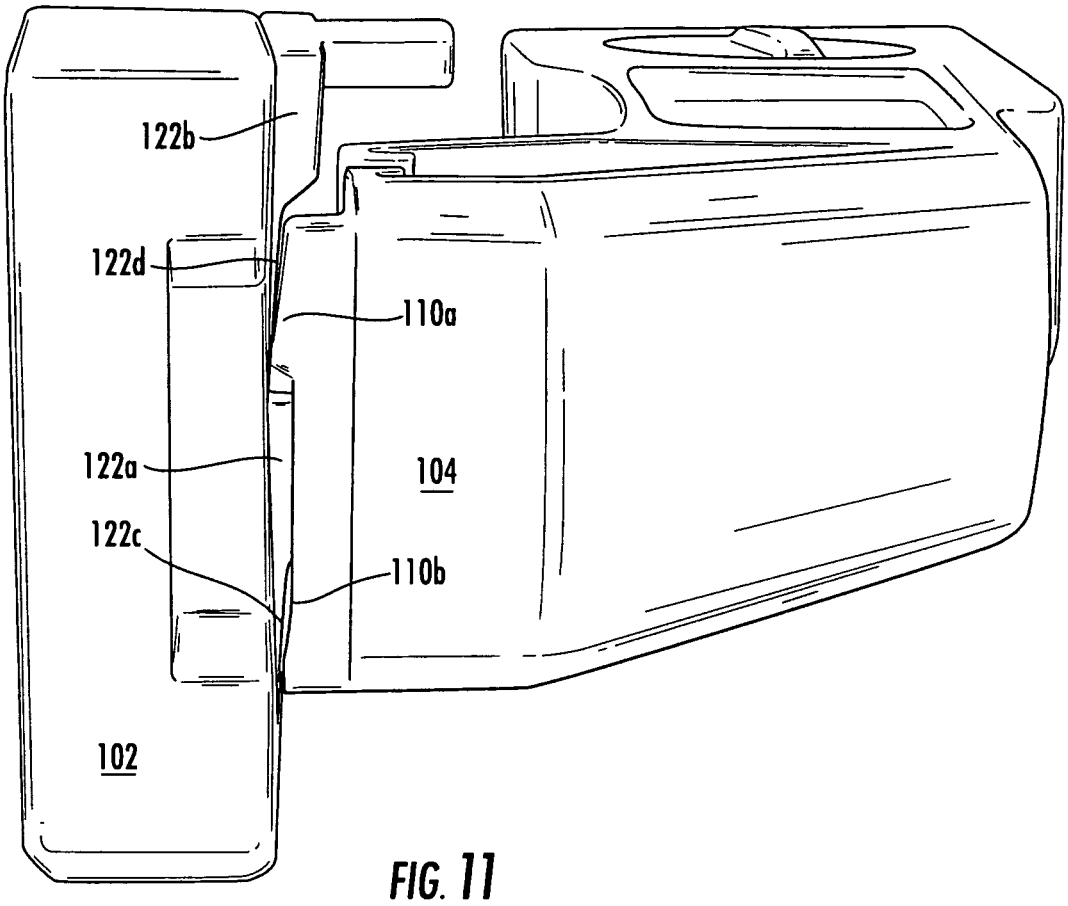
FIG. 11 is a perspective top view showing the jaw in a second unlocked position.
Figure 12:
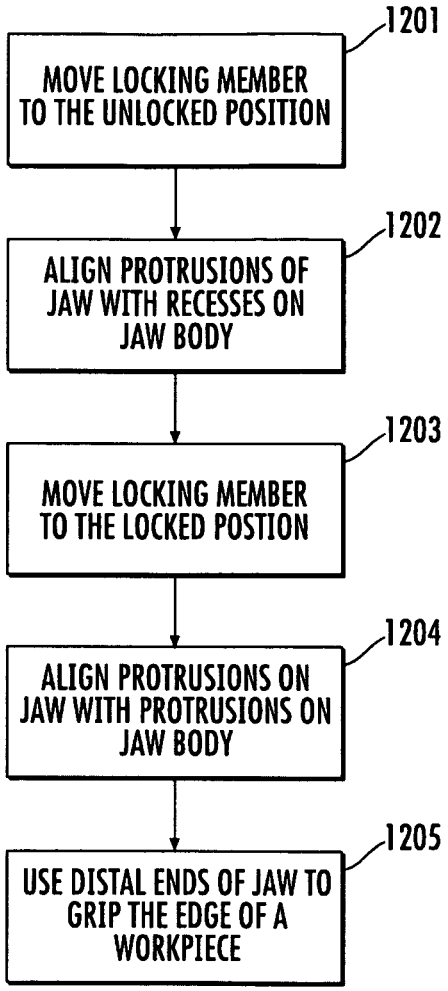
FIG. 12 is a block diagram showing the operation of the clamp of the invention.

Referring to FIG. 11, when the locking member is the second unlocked position the protrusions on the jaw body 110*a*, 110*b* and 112*a*, 112*b* are aligned with the recessed portions on the locking member 122*c*, 122*d* and 124*c*, 124*d*, respectively. In the unlocked position, the space created by aligning the protrusions with the opposed recesses allows the jaw 104 to rotate about pin 108 relative to jaw body 102. The locking member can be slid to the locked or unlocked position to lock or unlock the jaw as desired by the user by pushing or pulling on push tab 120 or flange 125. FIG. 11 shows the jaw 104 pivoted to a first extreme position where the distal end of the jaw is rotated towards the jaw body 102 such that protrusions are inserted into the opposed recesses. FIG. 10 shows the jaw 104 rotated to the opposite extreme position where the distal end of the jaw is rotated away from the jaw body 102. In this position the proximal end of the jaw 104 is disposed such that the protrusions are inserted into the opposed recesses.

Figure 13:
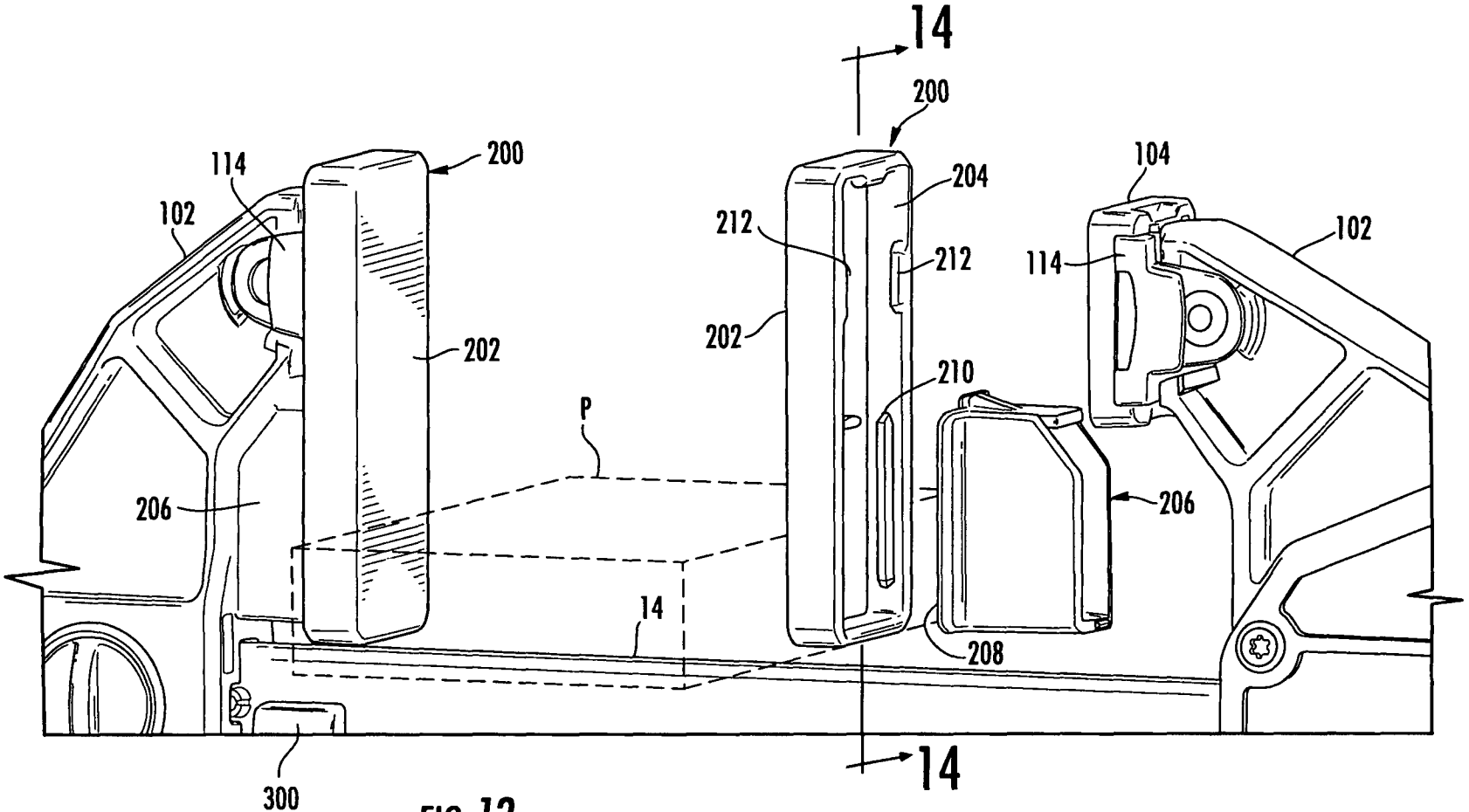
FIG. 13 is a partially exploded view of another embodiment of the clamp of the invention.
Figure 14:
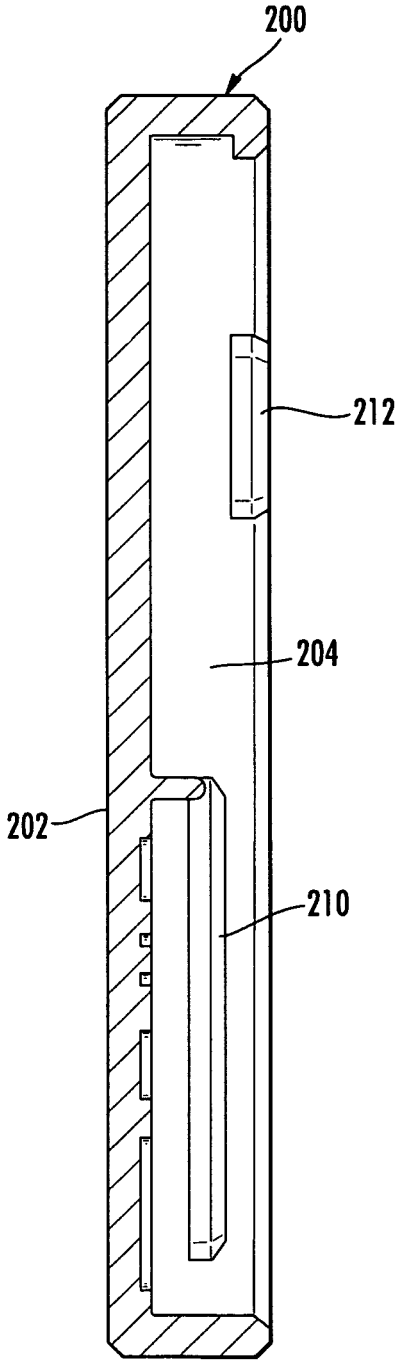
FIG. 14 is a section view of the full jaw face pad.

Referring to FIGS. 13 and 14, in another embodiment of the invention, jaw extensions are provided that extend the work piece contacting surfaces to extend from the pivoting jaw 104 to closely adjacent the bar 14. The jaw extensions comprise an extended jaw face pad 200 that is dimensioned so as to extend from the jaw 104 to closely adjacent the bar 14. The jaw face pad 200 may be of a relatively soft material so as to resiliently grip the work piece. The jaw face pad 200 includes a jaw face 202 for gripping the work piece and a cavity 204 formed in the back thereof.

Figure 16:
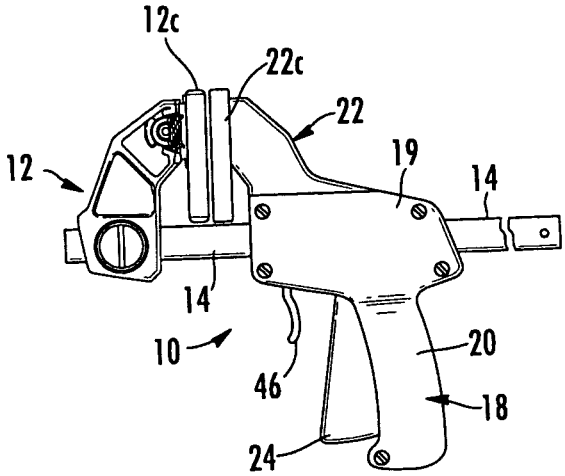
FIG. 16 is a side view of an embodiment of a clamp showing an alternate embodiment of the clamping faces.
Figure 17:
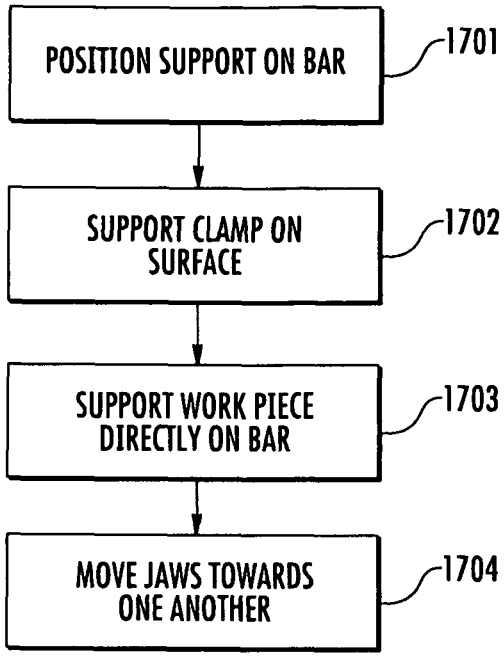
FIG. 17 is a block diagram showing another operation of the clamp of the invention.
Figure 18:
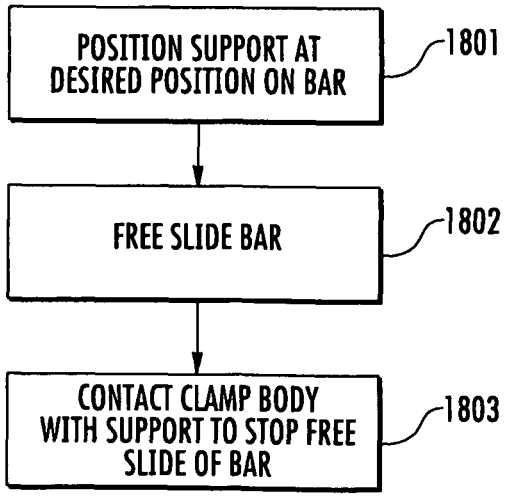
FIG. 18 is a block diagram showing yet another operation of the clamp of the invention.

A spacer member 206 is secured to the back of the jaw face pad 200. Specifically, spacer member 206 fits into the bottom portion of cavity 204 where flanges 208 formed on the spacer member 206 are engaged by flanges 210 formed in cavity 204 to trap the spacer member 206 in the cavity 204. While only one flange 210 and one flange 208 are visible in FIG. 13 it is to be understood that a flange 208 is formed on each side of the spacer member 206 and a mating flange 210 is formed along either side of cavity 204. Flanges 208 are retained behind flanges 210 to secure the spacer member 206 in the jaw face pad 200. Spacer member 206 is shaped and dimensioned to fit into the area of the jaw body below the jaw 104. The jaw 104 fits into the top portion of the cavity 204 where flanges 212 formed along the edges of cavity 204 engage the edges of the jaw 104 to retain the jaw face pad on the jaw 104. The jaw face pad 200 is removable from the jaw 104 such that the clamp can be converted from the extended face pad of FIGS. 13 and 14 to the standard jaw of FIGS. 1 through 11. The jaws with the extended face pad 200 can rotate as previously described if the locking member 114 is in the unlocked position, although the bottom of the jaws will rotate to a lesser degree because spacer member 206 contacts the jaw body 102. Normally, when the extended jaw face pads 200 are used, the locking member 114 will be in the locked position to prevent the rotation of the jaw although the full face pads may also be used in the unlocked position. While in the illustrated embodiment the extended jaw faces are provided as removable pads 200 that fit onto smaller size jaws 104, the jaws 104 could be formed with permanent extended jaw faces 12*c* and 22*c* where the jaw faces extend to closely adjacent the bar as shown in FIG. 16. FIG. 16 shows a fixed permanent extended face 22*c* and a pivoting permanent extended face 12*c* both of which extend to closely adjacent bar 14. In practice a clamp may be provided with two pivoting faces or two fixed jaw faces.

Figure 15:
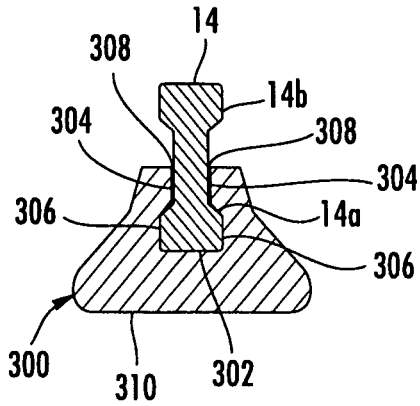
FIG. 15 is a section view taken along line 15-15 of FIG. 2.

Referring to FIGS. 2 and 15, an adjustable support 300 is mounted on the bar 14 to support the clamp on a horizontal surface S. Support 300 includes a slotted aperture 302 that is open at one end to receive and slidably grip the bar 14. Specifically, bar 14 may be made with a flange 14*a* that projects from both sides of the bar 14 at the lower edge thereof and extends for substantially the entire length of the bar. In the illustrated embodiment bar 14 includes a similar flange 14*b* at the upper edge thereof such that the bar has a substantially I-beam cross-sectional shape. The slotted aperture 302 of support 300 is defined by walls 304 that engage the flange 14*a* such that the support 300 can slide along the length of bar 14 but is otherwise secured to the bar. Walls 304 include recesses 306 that receive the flange 14*a* and projections 308 that define a space therebetween that is less than the width of the flange and through which the bar extends. The aperture 302, recesses 306, walls 304 and projections 308 are dimensioned such that a relatively snug friction fit is created between bar 14 and support 300. In another embodiment of the invention the frivtion may be produced by a mechanical spring or built in spring feature in support 300. Support 300 can be manually moved along the length of bar 14 but will remain in position on the bar once the user positions it on the bar.

Support 300 includes a relatively wide foot portion having a bottom surface 310 that rests on surface S to support the clamp in a position where bar 14 is substantially parallel to surface S. The bottom surface 310 of support 300 is located a distance below bar 14 equal to the distance that the bottom surface 12*a* of jaw 12 is located from the bar such that surface 310 and surface 12*a* are coplanar. In use support 300 is positioned spaced from jaw 12 such that the clamp can be supported on surface S on surfaces 310 and 12*a* with the bar 14 substantially parallel to surface S as shown in FIG. 2 and the jaws extending substantially perpendicularly to the surface. In this position the clamp 10 can support a work piece W where the clamp is free standing on surface S such that the clamp functions in a hands-free mode. Because the bottom 12*a* of jaw 12 is used to support one end of the clamp only one support 300 needs to be used.

Significantly, support 300 does not extend over the top edge of bar 14. As a result a work piece can be supported directly on the bar 14 without the support 300 being interposed between the bar and the work piece. This is the most effective way to support a work piece because the clamping force is directed along the long axis of the bar. By supporting the work piece on the bar, the clamping force is directed substantially along the work piece thereby minimizing forces on the work piece that are not along the clamping direction. Minimizing these forces minimizes torque and bending of the work piece. Moreover, the bar provides support to the work piece along the entire length of the bar. Referring to FIG. 13, using the jaw extensions of FIGS. 13 and 14 or the permanent extended faces shown in FIG. 16 allows even a relatively thin work piece P to be supported on bar 14 and clamped between the jaws.

Because of the relatively snug fit between support 300 and bar 14, the support may also be used to limit the "free slide" of the bar 14 during use. The "free slide" of the bar is the ability of the bar to slide in body 19 when the brake mechanism 46 is released such that jaw 12 can move toward jaw 22 by gravity or by manually pushing or pulling the bar 14. The support 300 can be positioned to stop the "free slide" of the bar at a desired position (block 1801). As bar 14 and jaw 12 "free slide" or move toward jaw 22 (block 1802), support 300 will contact body 19 to limit the free movement of the bar (block 1803). The support 300 can be positioned on bar 14 such that the jaw 12 is moved to the same position for repetitive applications. It is to be understood that because the support 300 can be manually slid on bar 14, the ability of the support 300 to act as a stop works provided that the force generated by the "free slide" movement of the bar 14 on support 14 is less than the friction force that holds the support 300 in place.

To use the clamping jaw of the invention to clamp a workpiece using the full face of the clamping jaw, the jaw is unlocked by moving locking member to the unlocked position (block 1201). The locking member is moved to the unlocked position by pulling or pushing the tab to move the recesses on the locking member into alignment with the protrusions on the clamp body (block 1202). In this position sufficient clearance is provided between the clamp body and locking member such that the jaw can rotate to align itself parallel to the workpiece. If it is desired to lock the jaw relative to the jaw body, the locking member is pushed to the locked position (block 1203) where the protrusions on the locking member engage the protrusions on the jaw (block 1204). In this position the distal ends of the jaws may be used to grip the edge of a workpiece (block 1205).

To use the clamp in a hands-free mode, support 300 is positioned spaced from jaw 12 (block 1701) such that the clamp can be supported on surface S on surfaces 310 and 12*a* with the bar 14 substantially parallel to surface S (block 1702). A work piece is supported directly on the bar 14 without the support 300 being interposed between the bar and the work piece (block 1703). Jaw 12 is moved toward jaw 22 by actuating trigger handle 24 (block 1704).

Specific embodiments of an invention are described herein. One of ordinary skill in the art will recognize that the invention has other applications in other environments. In fact, many embodiments and implementations are possible. The following claims are in no way intended to limit the scope of the invention to the specific embodiments described above.

The invention claimed is:

1. A clamp comprising:

a bar;

a first jaw body secured to the bar and supporting a movable jaw positioned on a top edge of the bar, the first jaw body defining a first bottom surface positioned on a bottom edge of the bar opposite to the movable jaw;

said bar being slidably received in a body having a handgrip positioned on the bottom edge of the bar and a second jaw body having a fixed jaw arranged such that the fixed jaw is positioned on the top edge of the bar;

a support slidably disposed on said bar between the first jaw body and the body and having a second bottom surface that is coplanar with said first bottom surface such that said clamp can be supported by said first bottom surface and said second bottom surface on a surface in a free standing manner with the movable jaw and the fixed jaw extending away from the surface, wherein said support does not extend over the top edge of the bar.

2. The clamp of claim 1 wherein said movable jaw comprises a first jaw face and said fixed jaw comprises a second jaw face where the first jaw face and the second jaw face extend to closely adjacent the top edge of said bar.

3. The clamp of claim 2 wherein said first jaw face includes a first jaw pad removably attached to said movable jaw and said second jaw face includes a second jaw pad removably attached to said fixed jaw.

4. The clamp of claim 3 wherein a first spacer element is attached to said first jaw pad and is positioned between said first jaw pad and said movable jaw and a second spacer element is attached to said second jaw pad and is positioned between the second jaw pad and said fixed jaw.

5. The clamp of claim 1 wherein said support includes a slotted aperture that is open at one end of the support to receive and slidably grip the bar.

6. The clamp of claim 5 wherein said bar includes a flange that projects from a lower edge of the bar and extends for substantially the entire length of the bar.

7. The clamp of claim 6 wherein said slotted aperture defines a space for receiving the flange where the space is less than the width of the flange.

8. The clamp of claim 1 wherein the bar has a substantially I-beam cross-sectional shape.

9. The clamp of claim 1 wherein a friction fit is created between bar and the support sufficient to hold the support in position on the bar.

10. The clamp of claim 1 wherein the support can be manually moved along the length of bar.

11. The clamp of claim 2 wherein said jaw face can swivel.

12. The clamp of claim 11 wherein said jaw face can be locked in position.

13. A method of operating a clamp comprising:

providing a bar supporting a jaw body comprising a movable jaw positioned on a top edge of the bar, the jaw body having a first bottom surface, said bar being slidably received in a body, said body having a fixed jaw positioned on the top edge of the bar; providing a support slidably disposed on said bar between the jaw body and the body and having a second bottom surface that is coplanar with said first bottom surface such that said clamp can be supported by said first bottom surface and said second bottom surface on a surface, wherein said support does not extend over the top edge of the bar;

positioning said support on said bar and supporting said clamp in a freestanding manner on the surface with the movable jaw and the fixed jaw extending away from the surface;

positioning a work piece directly on said bar; and moving the movable jaw relative to the fixed jaw to clamp the work piece between the movable jaw and the fixed jaw.

14. The method of claim 13 wherein positioning the support on the bar includes sliding the support along the length of the bar.

15. A method of operating a clamp comprising:

providing a bar supporting a movable jaw where said bar is slidably received in a body and a drive mechanism for moving the bar relative to the body in a first direction and allowing free movement of the bar relative to the body in a second direction, said body having a fixed jaw;

providing a support slidably disposed on said bar between the movable jaw and the body;

positioning said support on said bar; and allowing movement of the movable jaw relative to the fixed jaw in the second direction and stopping the movement of the movable jaw by the engagement of said support with said body, wherein said support does not extend over the top edge of the bar.

16. The method of claim 15 wherein positioning the support on the bar includes sliding the support along the length of the bar.

17. A clamp comprising:

a bar supporting a movable jaw;

said bar being slidably received in a body, said body supporting a fixed jaw wherein said movable jaw comprises a first jaw face and said fixed jaw comprises a second jaw face where the first jaw face and the second jaw face extend to closely adjacent said bar;

said first jaw face includes a first jaw pad removably attached to said movable jaw and said second jaw face includes a second jaw pad removably attached to the fixed jaw; and a first spacer element removably attached to said first jaw pad and positioned between said first jaw pad and said fixed jaw and a second spacer element removably attached to said second jaw pad and positioned between said second jaw pad and said movable jaw.

* * * * *